US008242068B2

(12) United States Patent
Warkotsch et al.

(10) Patent No.: US 8,242,068 B2
(45) Date of Patent: Aug. 14, 2012

(54) CLEANING AGENTS

(75) Inventors: Nadine Warkotsch, Dusseldorf (DE); Johannes Zipfel, Dusseldorf (DE); Thomas Holderbaum, Hilden (DE); Claudia Ottow, Ratingen (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/151,467

(22) Filed: Jun. 2, 2011

(65) Prior Publication Data

US 2011/0226288 A1 Sep. 22, 2011

Related U.S. Application Data

(63) Continuation of application No. PCT/EP2009/066100, filed on Dec. 1, 2009.

(30) Foreign Application Priority Data

Dec. 5, 2008 (DE) ..... 10 2008 060 470

(51) Int. Cl.
*C11D 3/37* (2006.01)

(52) U.S. Cl. ..... 510/220; 510/230

(58) Field of Classification Search ..... 510/220, 510/230

See application file for complete search history.

(56) References Cited

U.S. PATENT DOCUMENTS

| | | | | |
|---|---|---|---|---|
| 6,207,780 | B1 | 3/2001 | Stockhausen et al. | |
| 7,469,519 | B2 * | 12/2008 | Barthel et al. | 53/433 |
| 7,491,686 | B2 * | 2/2009 | Barthel et al. | 510/446 |
| 7,528,102 | B2 * | 5/2009 | Barthel et al. | 512/1 |
| 7,879,154 | B2 * | 2/2011 | Warkotsch et al. | 134/25.2 |
| 8,123,867 | B2 * | 2/2012 | Tropsch | 134/25.2 |
| 2005/0261156 | A1 * | 11/2005 | Kottwitz et al. | 510/392 |
| 2006/0094634 | A1 * | 5/2006 | Jekel et al. | 510/446 |
| 2006/0116309 | A1 * | 6/2006 | Lambotte et al. | 510/302 |
| 2006/0122089 | A1 * | 6/2006 | Lambotte et al. | 510/295 |
| 2006/0223738 | A1 * | 10/2006 | Holderbaum et al. | 510/439 |
| 2007/0009561 | A1 * | 1/2007 | Holderbaum et al. | 424/401 |
| 2007/0203047 | A1 * | 8/2007 | Pegelow et al. | 510/421 |
| 2007/0244026 | A1 * | 10/2007 | Barthel et al. | 510/445 |
| 2008/0045434 | A1 * | 2/2008 | Barthel et al. | 510/439 |
| 2008/0255020 | A1 * | 10/2008 | Holderbaum | 510/298 |
| 2009/0029055 | A1 * | 1/2009 | Holderbaum | 427/372.2 |
| 2010/0024846 | A1 * | 2/2010 | Warkotsch et al. | 134/25.2 |
| 2010/0029536 | A1 * | 2/2010 | Warkotsch et al. | 510/228 |
| 2010/0031976 | A1 * | 2/2010 | Warkotsch et al. | 134/25.2 |
| 2010/0041575 | A1 * | 2/2010 | Warkotsch et al. | 510/228 |
| 2010/0216683 | A1 * | 8/2010 | Kessler et al. | 510/221 |
| 2010/0249007 | A1 * | 9/2010 | Holderbaum et al. | 510/220 |
| 2010/0249008 | A1 * | 9/2010 | Holderbaum et al. | 510/224 |
| 2010/0249009 | A1 * | 9/2010 | Holderbaum et al. | 510/224 |
| 2010/0294309 | A1 * | 11/2010 | Tropsch | 134/18 |

FOREIGN PATENT DOCUMENTS

| | | | |
|---|---|---|---|
| DE | 200 19 913 | U1 | 5/2001 |
| DE | 10 2007 006 630 | A1 | 8/2008 |
| DE | 102007044417 | A1 * | 3/2009 |
| EP | 0692020 | B1 | 11/1997 |
| EP | 0662117 | B1 | 6/2000 |
| EP | 0906407 | B1 | 9/2001 |
| EP | 01113070 | B1 | 3/2008 |
| WO | WO2005/090540 | A1 | 9/2005 |
| WO | WO2006/018107 | A1 | 2/2006 |
| WO | WO2008/017620 | A1 | 2/2008 |

OTHER PUBLICATIONS

PCT International Search Report (PCT/EP2009/066100) dated Dec. 2, 2010.

* cited by examiner

*Primary Examiner* — Gregory Webb
(74) *Attorney, Agent, or Firm* — Paul A. Pappalardo

(57) ABSTRACT

Phosphate-free automatic dishwashing agents are disclosed that comprise (a) builder; (b) bleaching agent; (c) hydrophobically modified copolymer comprising at least one of mono- and polyunsaturated sulfonic acid monomers; (d) non-hydrophobically modified copolymer comprising at least one of mono- and polyunsaturated sulfonic acids; and (e) nonionic surfactant. The agents in accordance with the present invention are distinguished by excellent film deposition inhibition along with good washing and rinsing performance.

11 Claims, No Drawings

CLEANING AGENTS

CROSS-REFERENCE TO RELATED APPLICATIONS

This application is a continuation of PCT Application Serial No. PCT/EP2009/066100, filed on Dec. 1, 2009, which claims priority under 35 U.S.C. §119 to 10 2008 060 470.4 (DE), filed on Dec. 5, 2008. The disclosures PCT/EP2009/066100 and DE 10 2008 060 470.4 are hereby incorporated by reference in their entirety.

FIELD OF THE INVENTION

The present invention generally relates to cleaning agents and in particular to phosphate-free automatic dishwashing compositions comprising a combination of polymers having cleaning action.

BACKGROUND OF THE INVENTION

Machine-washed dishes typically have more strict cleaning requirements than hand-washed dishes. For instance, after automatic dishwashing, dishes should not only be completely free of food residue, but should also be free of any visible water hardness or other mineral salt deposits that may have originated from dried water drops when there is a lack of wetting agents.

Modern automatic dishwashing agents satisfy these requirements by incorporating washing, conditioning, water softening, and rinsing active ingredients, sometimes known to the consumer as "2-in-1" or "3-in-1" dishwashing agents. Automatic dishwashing agents intended for residential use contain builders as an essential component for successful washing and rinsing. On the one hand, these builders increase the alkalinity of the washing liquor, which aids in the saponification and emulsification of fats and oils. On the other hand, builders reduce the water hardness of the washing liquor by complexing the calcium ions present in the aqueous liquor. Alkali metal phosphates have proved to be particularly effective builders, and for that reason they form the main ingredient in a majority of automatic dishwashing agents.

Although phosphates are highly desirable in automatic dishwashing agents for the performance benefit, their use is problematic from an environmental standpoint. A significant portion of the phosphate used in dishwashing passes with the domestic wastewater into standing bodies of water such as lakes and reservoirs to contribute to eutrophication or overfertilization. As a consequence of this phenomenon, the use of pentasodium triphosphate in laundry detergents has been extensively regulated in a number of countries including the USA, Canada, Italy, Sweden, Norway, and has been entirely prohibited in Switzerland. In Germany, since 1984, the content of this builder permitted in washing agents has been limited to 20%.

In addition to nitrilotriacetic acid, sodium aluminum silicates (zeolites) are primarily used as phosphate replacements or substitutes in textile washing agents. However, for various reasons, these substances are not suitable for use in automatic dishwashing agents. As a consequence, various alternatives to alkali metal phosphates, most particularly citrates, have been discussed in the literature for use in automatic dishwashing agents.

European patents EP 662 117 B1 (Henkel KGaA) and EP 692 020 B1 (Henkel KGaA), for example, describe phosphate-free automatic dishwashing agents which, in addition to a citrate, furthermore contain carbonates, bleaching agents and enzymes.

As another alternative to alkali metal phosphates, and preferably used in combination with citrates, is methylglycinediacetic acid (MGDA). For example, European patent EP 906 407 B1 (Reckitt Benckiser) and European patent application EP 1 113 070 A2 (Reckitt Benckiser) describe MGDA-containing automatic dishwashing agents.

Despite the efforts made to date, manufacturers of automatic dishwashing agents have failed to provide phosphate-free automatic dishwashing agents that are comparable to, or that surpass, phosphate-containing cleaning agents with regard to their washing and rinsing performance and their ability to inhibit film deposition. Such equality of performance is a prerequisite for the successful market introduction of phosphate-free cleaning agents, since the majority of end consumers, despite the widespread public discussion of environmental issues, will always decide against an environmentally advantageous product if this product is not in line with the market standard in terms of price and/or performance.

In light of this background, the need still exists for phosphate-free automatic dishwashing agents that have at least comparable washing and rinsing performance to conventional phosphate-containing cleaning agents. Even more desirable and needed are new phosphate-free automatic dishwashing that can surpass conventional phosphate-containing dishwashing compositions in washing performance, rinsing performance, and inhibition of film deposition.

SUMMARY OF THE INVENTION

It has been surprisingly found that when a mixture of specific polymers containing sulfonic acid groups is included in automatic dishwashing agents that comprise nonionic surfactant, builder, and bleaching agent, excellent film deposition inhibition and washing and rinsing performance is observed, even in the absence of alkali metal phosphates.

In general, the present invention is a phosphate-free automatic dishwashing agent that comprises, in addition to builder and bleaching agent, (a) a hydrophobically-modified copolymer comprising monomers from the group consisting of mono- or poly-unsaturated sulfonic acids; (b) a non-hydrophobically modified copolymer comprising monomers selected from the group consisting of mono- or poly-unsaturated sulfonic acids; and, (c) nonionic surfactant.

The automatic dishwashing agents according to the present invention contain builders, bleaching agents, copolymers A and B, and nonionic surfactant C. By using a mixture of copolymers A and B together in the dishwashing agent, rather than either copolymer A or B alone, surprisingly better rinsing results are found.

DETAILED DESCRIPTION OF THE INVENTION

The present invention is a phosphate-free automatic dishwashing agent that comprises, in addition to builder and bleaching agent, (a) a hydrophobically-modified copolymer (designated copolymer A) comprising monomers from the group consisting of mono- or poly-unsaturated sulfonic acids; (b) a non-hydrophobically modified copolymer (designated copolymer B) comprising monomers selected from the group consisting of mono- or poly-unsaturated sulfonic acids; and, (c) nonionic surfactant (designated surfactant C).

Builders are an essential component of the dishwashing agents according to the present invention. The group of builders particularly includes citrates as well as carbonates and organic co-builders.

The term "citrate" here includes both citric acid and the citrate salts thereof, in particular the alkali metal citrate salts. Particularly preferred automatic dishwashing agents according to the invention contain citric acid and citrate, preferably sodium citrate, in quantities of 5 to 60 wt. %, preferably of 10 to 50 wt. % and in particular of 15 to 40 wt. %.

It is particularly preferred to use carbonate(s) and/or hydrogencarbonate(s), preferably alkali metal carbonate(s), particularly preferably sodium carbonate, in quantities of 5 to 50 wt. %, preferably of 10 to 40 wt. % and in particular of 15 to 30 wt. %, in each case relative to the weight of the automatic dishwashing agent.

TABLE 1 below shows preferred exemplary formulations for automatic dishwashing agents according to the present invention.

TABLE 1

Exemplary Automatic Dishwashing Agents

| Ingredient | Formulation 1 [wt. %] | Formulation 2 [wt. %] | Formulation 3 [wt. %] | Formulation 4 [wt. %] |
|---|---|---|---|---|
| Citrate | 5.0 to 60 | 10 to 50 | 10 to 50 | 15 to 40 |
| Carbonate | 5.0 to 50 | 5.0 to 50 | 10 to 40 | 15 to 30 |
| Bleaching agent | 1.0 to 20 | 2.0 to 15 | 2.0 to 15 | 4.0 to 12 |
| Copolymer A | 1.0 to 12 | 2.0 to 10 | 2.0 to 10 | 3.0 to 8.0 |
| Copolymer B | 2.0 to 16 | 4.0 to 14 | 4.0 to 14 | 6.0 to 12 |
| Nonionic surfactant C | 0.5 to 8 | 1.0 to 7.0 | 1.0 to 7.0 | 2.0 to 6.0 |
| Misc. | q.s | q.s | q.s | q.s |

Polycarboxylates/polycarboxylic acids, dextrins and phosphonates may be used as organic co-builders. These classes of substances are described below.

Usable organic co-builders include for example polycarboxylic acids usable in the form of the free acid and/or the sodium salts thereof, where polycarboxylic acids mean those carboxylic acids having more than one acid function. Examples include adipic acid, succinic acid, glutaric acid, malic acid, tartaric acid, maleic acid, fumaric acid, saccharic acids, aminocarboxylic acids, and nitrilotriacetic acid (NTA), and mixtures thereof. Apart from their builder action, the free acids are typically acidifying and thus also serve to lower pH forming a gentler pH value for the washing or cleaning agents. Succinic acid, glutaric acid, adipic acid, gluconic acid and any desired mixtures of these may in particular be mentioned.

In addition to 1-hydroxyethane-1,1-diphosphonic acid, the complexing phosphonates comprise a series of different compounds such as for example diethylenetriaminepenta(methylenephosphonic acid) (DTPMP). Hydroxyalkane- or aminoalkane phosphonates are particularly preferred in the present invention. Among hydroxyalkanephosphonates, 1-hydroxyethane-1,1-diphosphonate (HEDP) is of particular significance as a co-builder. It is preferably used as the sodium salt, the disodium salt exhibiting a neutral reaction and the tetrasodium salt an alkaline (pH 9) reaction. Aminoalkanephosphonates, which may be preferably considered, include ethylenediaminetetramethylenephosphonate (EDTMP), diethylenetriaminepentamethylene-phosphonate (DTPMP) as well as the higher homologs thereof. They are preferably used in the form of the sodium salts which exhibit a neutral reaction, for example as the hexasodium salt of EDTMP or as the hepta- and octasodium salt of DTPMP. From the class of phosphonates, HEDP is preferably used here as a builder. Aminoalkanephosphonates furthermore exhibit a pronounced heavy metal binding capacity. Accordingly, it may be preferred, especially if the agents also contain bleach, to use aminoalkanephosphonates, in particular DTPMP, or mixtures of the stated phosphonates.

A preferred embodiment of the automatic dishwashing agent in accordance with the present invention comprises one or more phosphonates selected from the group consisting of aminotrimethylenephosphonic acid (ATMP) and/or salts thereof, ethylenediaminetetra(methylenephosphonic acid) (EDTMP) and/or salts thereof, diethylenetriaminepenta(methylenephosphonic acid) (DTPMP) and/or salts thereof, 1-hydroxyethane-1,1-diphosphonic acid (HEDP) and/or salts thereof, 2-phosphonobutane-1,2,4-tricarboxylic acid (PBTC) and/or salts thereof, hexamethylenediaminetetra(methylenephosphonic acid) (HDTMP) and/or salts thereof, and nitrilotri(methylenephosphonic acid) (NTMP) and/or salts thereof, and mixtures thereof.

Particularly preferred automatic dishwashing agents are those which contain 1-hydroxyethane-1,1-diphosphonic acid (HEDP) or diethylenetriaminepenta-(methylenephosphonic acid) (DTPMP) as phosphonates.

The automatic dishwashing agents according to the invention may, of course, contain two or more different phosphonates.

The proportion by weight of phosphonates in the total weight of automatic dishwashing agents according to the invention preferably amounts to 1 to 8 wt. %, preferably to 1.2 to 6 wt. % and in particular to 1.5 to 4 wt. %.

Another essential component of automatic dishwashing agents according to the invention are the bleaching agents, wherein the oxygen bleaching agents being the preferred bleaching agents according to the invention.

Among those compounds acting as bleaching agents and releasing $H_2O_2$ in water, sodium percarbonate, sodium perborate tetrahydrate and sodium perborate monohydrate are of particular significance. Further usable bleaching agents are, for example, peroxypyrophosphates, citrate perhydrates and $H_2O_2$-releasing per-acidic salts or per-acids, such as perbenzoates, peroxophthalates, diperazelaic acid, phthaloimino per-acid or diperdodecanedioic acid. Bleaching agents from the group of organic bleaching agents may also be used. Typical organic bleaching agents include diacyl peroxides, such as for example dibenzoyl peroxide. Other typical organic bleaching agents include peroxy acids, with alkylperoxy acids and arylperoxy acids of particular mention.

Preferred phosphate-free automatic dishwashing agents are characterized in that the dishwashing agent contains, in each case relative to the total weight of the dishwashing agent, 1.0 to 20 wt. %, preferably 2 to 15 wt. % and in particular 4 to 12 wt. % of sodium percarbonate.

In order to achieve enhanced bleaching action when washing at temperatures of 60° C. and below, the automatic dishwashing agents according to the invention may also contain bleach activators. Bleach activators that may be used are compounds which, under perhydrolysis conditions, yield aliphatic peroxycarboxylic acids with preferably 1 to 10 carbon atoms, in particular 2 to 4 carbon atoms, and/or optionally substituted perbenzoic acid. Suitable substances are those which bear O- and/or N-acyl groups having the stated number of carbon atoms and/or optionally substituted benzoyl groups. Polyacylated alkylenediamines are preferred, tetraacetylethylenediamine (TAED) having proved to be particularly suitable.

These bleach activators, and in particular TAED, are preferably used in quantities of up to 10 wt. %, in particular of 0.1 wt % to 8 wt. %, particularly of 2 to 8 wt. % and particularly preferably of 2 to 6 wt. %, in each case relative to the total weight of the preparations containing bleach activator.

"Bleach catalysts" may also be used in addition to or instead of conventional bleach activators. These substances comprise bleach-boosting transition metal salts or transition metal complexes such as for example Mn, Fe, Co, Ru or Mo salen complexes or carbonyl complexes. Mn, Fe, Co, Ru, Mo, Ti, V and Cu complexes with nitrogenous tripod ligands and Co, Fe, Cu and Ru amine complexes may also be used as bleach catalysts.

Complexes of manganese in oxidation state II, III, IV or IV that preferably contain one or more macrocyclic ligand(s) with N, NR, PR, O and/or S donor functions are particularly preferred. Ligands that comprise nitrogen donor functions are preferably used. It is here particularly preferred to use bleach catalyst(s) in the agents according of the present invention that contain 1,4,7-trimethyl-1,4,7-triazacyclononane (Me-TACN), 1,4,7-triazacyclononane (TACN), 1,5,9-trimethyl-1,5,9-triazacyclododecane (Me-TACD), 2-methyl-1,4,7-trimethyl-1,4,7-triazacyclononane (Me/Me-TACN) and/or 2-methyl-1,4,7-triazacyclononane (Me/TACN) as the macromolecular ligand. Suitable manganese complexes include for example $[Mn^{III}_2(\mu\text{-}O)_1(\mu\text{-}OAc)_2(TACN)_2](ClO_4)_2$, $[Mn^{III}Mn^{IV}(\mu\text{-}O)_2(\mu\text{-}OAc)_1(TACN)_2](BPh_4)_2$, $[Mn^{IV}_4(\mu\text{-}O)_6(TACN)_4](ClO_4)_4$, $[Mn^{III}_2(\mu\text{-}O)_1(\mu\text{-}OAc)_2(Me\text{-}TACN)_2](ClO_4)_2$, $[Mn^{III}Mn^{IV}(\mu\text{-}O)_1(\mu\text{-}OAc)_2(Me\text{-}TACN)_2](ClO_4)_3$, $[Mn^{IV}_2(\mu\text{-}O)_3(Me\text{-}TACN)_2](PF_6)_2$ and $[Mn^{IV}_2(\mu\text{-}O)_3(Me/Me\text{-}TACN)_2](PF_6)_2(OAc{=}OC(O)CH_3)$.

Automatic dishwashing agents that also contain a bleach catalyst selected from the group consisting of bleach-boosting transition metal salts and transition metal complexes, and preferably selected from the group of complexes of manganese with 1,4,7-trimethyl-1,4,7-triazacyclononane ($Me_3$-TACN) or 1,2,4,7-tetramethyl-1,4,7-triazacyclononane ($Me_4$-TACN), are preferred according to the invention since the above-stated bleach catalysts can bring about a significant improvement in cleaning.

The above-stated bleach-boosting transition metal complexes, in particular with Mn and Co central atoms, are used in conventional quantities, preferably in a quantity of up to 5 wt. %, in particular of 0.0025 wt. % to 1 wt. % and particularly preferably of 0.01 wt. % to 0.30 wt. %, in each case relative to the total weight of the agents containing bleach catalyst. In specific cases, however, more bleach catalyst may also be used.

TABLE 2 below shows additional example formulations of preferred automatic dishwashing agents according to the invention.

TABLE 2

Additional Exemplary Automatic Dishwashing Agents

| Ingredient | Formulation 1 [wt. %] | Formulation 2 [wt. %] | Formulation 3 [wt. %] | Formulation 4 [wt. %] |
|---|---|---|---|---|
| Citrate | 5.0 to 60 | 10 to 50 | 10 to 50 | 15 to 40 |
| Carbonate | 5.0 to 50 | 5.0 to 50 | 10 to 40 | 15 to 30 |
| Sodium percarbonate | 1.0 to 20 | 2.0 to 15 | 2.0 to 15 | 4.0 to 12 |
| Copolymer A | 1.0 to 12 | 2.0 to 10 | 2.0 to 10 | 3.0 to 8.0 |
| Copolymer B | 2.0 to 16 | 4.0 to 14 | 4.0 to 14 | 6.0 to 12 |
| Nonionic surfactant C | 0.5 to 8 | 1.0 to 7.0 | 1.0 to 7.0 | 2.0 to 6.0 |
| Bleach activator | 0 to 8 | 0 to 8 | 0 to 8 | 2.0 to 6.0 |
| Bleach catalyst | 0 to 5.0 | 0 to 1.0 | 0 to 1.0 | 0.0025 to 1.0 |
| Phosphonate | 0 to 8.0 | 1 to 8.0 | 0 to 8.0 | 0 to 8.0 |
| Misc. | q.s | q.s | q.s | q.s |

The hydrophobically-modified copolymers A are the third essential component of the automatic dishwashing agents according to the present invention. In addition to a monomer selected from the group consisting of mono- or poly-unsaturated sulfonic acids, these copolymers also comprise at least one hydrophobic monomer.

Preferred monomers containing sulfonic acid groups are those of the general formula $R^5(R^6)C{=}C(R^7)—X—SO_3H$, in which $R^5$ to $R^7$ mutually independently denote —H, $—CH_3$, a straight-chain or branched saturated alkyl residue with 2 to 12 carbon atoms, a straight-chain or branched, mono- or poly-unsaturated alkenyl residue with 2 to 12 carbon atoms, alkyl or alkenyl residues substituted with $—NH_2$, —OH or —COOH, or denote —COOH or $—COOR^4$, with $R^4$ being a saturated or unsaturated, straight-chain or branched hydrocarbon residue with 1 to 12 carbon atoms, and X denoting an optionally present spacer group which is selected from $—(CH_2)_n—$ with n=0 to 4, $—COO—(CH_2)_k—$ with k=1 to 6, $—C(O)—NH—C(CH_3)_2—$, $—C(O)—NH—C(CH_3)_2CH_2—$ and $—C(O)—NH—CH(CH_2CH_3)—$.

Preferred among these monomers are those of the formulae $H_2C{=}CH—X—SO_3H$; $H_2C{=}C(CH_3)—X—SO_3H$; and, $HO_3S—X—(R^6)C{=}C(R^7)—X—SO_3H$, in which $R^6$ and $R^7$ are mutually independently selected from —H, $—CH_3$, $—CH_2CH_3$, $—CH_2CH_2CH_3$, $—CH(CH_3)_2$ and X denotes an optionally present spacer group which is selected from $—(CH_2)_n—$ with n=0 to 4, $—COO—(CH_2)_k—$ with k=1 to 6, $—C(O)—NH—C(CH_3)_2—$, $—C(O)—NH—C(CH_3)_2CH_2—$ and $—C(O)—NH—CH(CH_2CH_3)—$.

Particularly preferred monomers containing sulfonic acid groups include 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy)propanesulfonic acid, 2-methyl-2-propene-1-sulfonic acid, styrenesulfonic acid, vinylsulfonic acid, 3-sulfopropyl acrylate, 3-sulfopropyl methacrylate, sulfomethacrylamide, and sulfomethylmethacrylamide, and mixtures of these acids or the water-soluble salts thereof.

The sulfonic acid groups may be present in the polymers entirely, or in part, in a neutralized form. That is, the acidic hydrogen atom of the sulfonic acid group may be replaced in some or all of the sulfonic acid groups with metal ions, preferably alkali metal ions, and in particular sodium ions. It is preferred according to the invention to use copolymers containing partially or completely neutralized sulfonic acid groups.

Preferred hydrophobic monomers include those of the general formula $R^1(R^2)C{=}C(R^3)—X—R^4$, in which $R^1$ to $R^3$ mutually independently denote —H, $—CH_3$ or $—C_2H_5$, X denotes an optionally present spacer group which is selected from $—CH_2—$, —C(O)O— and —C(O)—NH—, and $R^4$ denotes a straight-chain or branched saturated alkyl residue with 2 to 22 carbon atoms or denotes an unsaturated, preferably aromatic, residue with 6 to 22 carbon atoms.

Particularly preferred hydrophobic monomers include butene, isobutene, pentene, 3-methylbutene, 2-methylbutene, cyclopentene, hexene, 1-hexene, 2-methyl-1-pentene, 3-methyl-1-pentene, cyclohexene, methylcyclopentene, cycloheptene, methylcyclohexene, 2,4,4-trimethyl-1-pentene, 2,4,4-trimethyl-2-pentene, 2,3-dimethyl-1-hexene, 2,4-dimethyl-1-hexene, 2,5-dimethyl-1-hexene, 3,5-dimethyl-1-hexene, 4,4-dimethyl-1-hexane, ethylcyclohexyne, 1-octene, α-olefins with 10 or more carbon atoms such as for example 1-decene, 1-dodecene, 1-hexadecene, 1-octadecene and $C_{22}$-α-olefin, 2-styrene, α-methylstyrene, 3-methylstyrene, 4-propylstyrene, 4-cyclohexylstyrene, 4-dodecylstyrene, 2-ethyl-4-benzylstyrene, 1-vinylnaphthalene, 2-vinylnaphthalene, methyl acrylate, ethyl acrylate, propyl acrylate, butyl acrylate, pentyl acrylate, hexyl acrylate, methyl methacrylate, N-(methyl)acrylamide, 2-ethylhexyl acrylate, 2-ethylhexyl methacrylate, N-(2-ethylhexyl)acrylamide, octyl acrylate, octyl methacrylate, N-(octyl)acrylamide, lauryl acrylate, lauryl methacrylate, N-(lauryl)acrylamide, stearyl acrylate, stearyl methacrylate, N-(stearyl)acrylamide, behenyl acrylate, behenyl methacrylate, and N-(behenyl)acrylamide, and mixtures thereof.

Phosphate-free automatic dishwashing agents which are preferred according to the invention comprise a hydrophobically-modified copolymer A comprising monomers selected from the group consisting of mono- or poly-unsaturated sulfonic acids, and monomers of general formula $R^1(R^2)C{=}C(R^3){-}X{-}R^4$, wherein $R^1$ to $R^3$ mutually independently denote —H, —$CH_3$ or —$C_2H_5$, X denotes an optionally present spacer group which is selected from —$CH_2$—, —C(O)O— and —C(O)—NH—, and $R^4$ denotes a straight-chain or branched saturated alkyl residue with 2 to 22 carbon atoms or denotes an unsaturated, preferably aromatic residue with 6 to 22 carbon atoms.

In one particularly preferred embodiment according to the invention of automatic dishwashing agents, the agents comprise hydrophobically-modified copolymer A having monomers selected from the group consisting of mono- or poly-unsaturated carboxylic acids.

Preferred phosphate-free automatic dishwashing agents in accordance with the present invention comprise a hydrophobically modified copolymer A further comprising: monomers selected from the group consisting of mono- or poly-unsaturated sulfonic acids, monomers selected from the group consisting of mono- or poly-unsaturated carboxylic acids, and monomers of the general formula $R^1(R^2)C{=}C(R^3){-}X{-}R^4$, wherein $R^1$ to $R^3$ mutually independently denote —H, —$CH_3$ or —$C_2H_5$, X denotes an optionally present spacer group which is selected from —$CH_2$—, —C(O)O— and —C(O)—NH—, and $R^4$ denotes a straight-chain or branched saturated alkyl residue with 2 to 22 carbon atoms or denotes an unsaturated, preferably aromatic residue with 6 to 22 carbon atoms.

Preferred monomers for copolymer A include those from the group consisting of carboxylic acids having general formula $R^1(R^2)C{=}C(R^3)COOH$, wherein $R^1$ to $R^3$ mutually independently denote —H, —$CH_3$, a straight-chain or branched saturated alkyl residue with 2 to 12 carbon atoms, a straight-chain or branched, mono- or poly-unsaturated alkenyl residue with 2 to 12 carbon atoms, alkyl or alkenyl residues substituted with —$NH_2$, —OH or —COOH as defined above or denote —COOH or —$COOR^4$, $R^4$ being a saturated or unsaturated, straight-chain or branched hydrocarbon residue with 1 to 12 carbon atoms.

Particularly preferred monomers containing carboxyl groups include acrylic acid, methacrylic acid, ethacrylic acid, α-chloroacrylic acid, α-cyanoacrylic acid, crotonic acid, α-phenylacrylic acid, maleic acid, maleic anhydride, fumaric acid, itaconic acid, citraconic acid, methylenemalonic acid, sorbic acid, and cinnamic acid, and mixtures thereof. Acrylic acid and methacrylic acid are particularly preferred.

The proportion by weight of hydrophobically-modified copolymer A in the total weight of phosphate-free automatic dishwashing agents according to the invention preferably amounts to 1 to 12 wt. %, preferably to 2 to 10 wt. % and in particular to 3 to 8 wt. %.

The automatic dishwashing agents according to the invention also comprise non-hydrophobically-modified copolymer B as an essential component. This copolymer B contains at least one monomer from the group consisting of mono- or poly-unsaturated sulfonic acids. The monomers preferred for use in copolymer B include the identical sulfonic acids that are preferred for use in copolymer A, which are discussed above and incorporated herein by reference.

In addition to the monomers selected from the group consisting of mono- or poly-unsaturated sulfonic acids, preferred copolymers B may also comprise at least one monomer selected from the group consisting of mono- or poly-unsaturated carboxylic acids.

Preferred phosphate-free automatic dishwashing agents in accordance with the present invention include a non-hydrophobically modified copolymer B comprising monomers selected from the group consisting of mono- or poly-unsaturated sulfonic acids, and monomers selected from the group consisting of mono- or polyunsaturated carboxylic acids.

The proportion by weight of copolymer B in the total weight of phosphate-free automatic dishwashing agents according to the invention preferably amounts to 2 to 16 wt. %, preferably to 4 to 14 wt. % and in particular to 6 to 12 wt. %.

The molar mass of the sulfo copolymers A preferably used according to the invention may be varied in order to tailor the properties of the polymers to the intended application. Preferred automatic dishwashing agents are characterized in that the copolymers A and B have molar masses of 2000 to 200,000 $gmol^{-1}$, preferably of 4000 to 25,000 $gmol^{-1}$ and in particular of 5000 to 15,000 $gmol^{-1}$.

TABLE 3 below shows some further example formulations for preferred automatic dishwashing agents according to the invention.

TABLE 3

Additional Exemplary Automatic Dishwashing Agents

| Ingredient | Formulation 1 [wt. %] | Formulation 2 [wt. %] | Formulation 3 [wt. %] | Formulation 4 [wt. %] |
|---|---|---|---|---|
| Citrate | 5.0 to 60 | 10 to 50 | 10 to 50 | 15 to 40 |
| Carbonate | 5.0 to 50 | 5.0 to 50 | 10 to 40 | 15 to 30 |
| Sodium percarbonate | 1.0 to 20 | 2.0 to 15 | 2.0 to 15 | 4.0 to 12 |
| Copolymer A[1)] | 1.0 to 12 | 2.0 to 10 | 2.0 to 10 | 3.0 to 8.0 |
| Copolymer B[2)] | 2.0 to 16 | 4.0 to 14 | 4.0 to 14 | 6.0 to 12 |
| Nonionic surfactant C | 0.5 to 8 | 1.0 to 7.0 | 1.0 to 7.0 | 2.0 to 6.0 |
| Bleach activator | 0 to 8 | 0 to 8 | 0 to 8 | 2.0 to 6.0 |
| Bleach catalyst | 0 to 5.0 | 0 to 1.0 | 0 to 1.0 | 0.0025 to 1.0 |
| Phosphonate | 0 to 8.0 | 1 to 8.0 | 0 to 8.0 | 0 to 8.0 |
| Misc. | q.s | q.s | q.s | q.s |

NOTES:

[1)]Copolymer A in TABLE 3 comprises: -monomers from the group of mono- or poly-unsaturated sulfonic acids; -monomers from the group of mono- or poly-unsaturated carboxylic acids; -monomers of the general formula $R^1(R^2)C{=}C(R^3){-}X{-}R^4$, in which $R^1$ to $R^3$ mutually independently denote —H, —$CH_3$ or —C2$H_5$, X denotes an optionally present spacer group which is selected from —$CH_2$—, —C(O)O— and —C(O)—NH—, and $R^4$ denotes a straight-chain or branched saturated alkyl residue with 2 to 22 carbon atoms or denotes an unsaturated, preferably aromatic residue with 6 to 22 carbon atoms.

[2)]Copolymer B in TABLE 3 comprises: -monomers from the group of mono- or poly-unsaturated sulfonic acids; -monomers from the group of mono- or poly-unsaturated carboxylic acids.

The agents according to the present invention also comprise surfactants. Surfactants are taken to encompass nonionic, anionic, cationic and amphoteric surfactants. The automatic dishwashing agents preferably contain nonionic surfactants in quantities of between 0.5 and 8 wt. %.

Preferred phosphate-free automatic dishwashing agents in accordance with the present invention comprise nonionic surfactant C in amounts of 0.5 to 8 wt. %, preferably to 1 to 7 wt. % and in particular to 2 to 6 wt. %, based on the total weight of the automatic dishwashing agent.

Any nonionic surfactants known to a person skilled in the art may be used as the nonionic surfactants herein. Examples of suitable nonionic surfactants include alkyl glycosides of the general formula $RO(G)_x$, in which R corresponds to a primary straight-chain or methyl-branched aliphatic residue, in particular methyl-branched in position 2, with 8 to 22, preferably 12 to 18 carbon atoms, and where G denotes a glycose unit with 5 or 6 carbon atoms, preferably glucose. The degree of oligomerization x, which indicates the distribution of monoglycosides and oligoglycosides, is any desired number between 1 and 10; x is preferably 1.2 to 1.4.

Nonionic surfactants of the amine oxide type, for example N-coconut alkyl-N,N-dimethylamine oxide and N-tallow alcohol-N,N-dihydroxyethylamine oxide, and of the fatty acid alkanolamide type may also be suitable. The quantity of these nonionic surfactants preferably amounts to no more than that of the ethoxylated fatty alcohols discussed below, and in particular not more than half the quantity thereof.

An additional preferred class of nonionic surfactants is the alkoxylated fatty acid alkyl esters. These surfactants, which may be used either as the sole nonionic surfactant or in combination with other nonionic surfactants, include the alkoxylated, preferably ethoxylated or ethoxylated and propoxylated fatty acid alkyl esters, preferably with 1 to 4 carbon atoms in the alkyl chain.

Low-foaming nonionic surfactants are used as preferred surfactants. Washing or cleaning agents, in particular cleaning agents for automatic dishwashing, preferentially contain nonionic surfactants from the group of alkoxylated alcohols. Alkoxylated, advantageously ethoxylated, in particular primary alcohols with preferably 8 to 18 carbon atoms and on average 1 to 12 mol of ethylene oxide (EO) per mol of alcohol, in which the alcohol residue may be linear or preferably methyl-branched in position 2 or may contain linear and methyl-branched residues in the mixture, as are usually present in oxo alcohol residues, are preferably used as nonionic surfactants. In particular, however, alcohol ethoxylates with linear residues prepared from alcohols of natural origin with 12 to 18 carbon atoms, for example from coconut, palm, tallow fat or oleyl alcohol, and on average 2 to 8 mol of EO per mol of alcohol are preferred. Preferred ethoxylated alcohols include, for example, $C_{12-14}$ alcohols with 3 EO or 4 EO, $C_{9-11}$ alcohol with 7 EO, $C_{13-15}$ alcohols with 3 EO, 5 EO, 7 EO or 8 EO, $C_{12-18}$ alcohols with 3 EO, 5 EO or 7 EO and mixtures of these, such as mixtures of $C_{12-14}$ alcohol with 3 EO and $C_{12-18}$ alcohol with 5 EO. The stated degrees of ethoxylation are statistical averages which, for a specific product, may be an integer or a fractional number. Preferred alcohol ethoxylates have a narrow homolog distribution (narrow range ethoxylates, NRE). In addition to these nonionic surfactants, fatty alcohols with more than 12 EO may also be used. Examples of these are tallow fatty alcohol with 14 EO, 25 EO, 30 EO or 40 EO.

Ethoxylated nonionic surfactants which were obtained from $C_{6-20}$ monohydroxyalkanols or $C_{6-20}$ alkylphenols or $C_{16-20}$ fatty alcohols and more than 12 mole, preferably more than 15 mole, and in particular more than 20 moles of ethylene oxide per mole of alcohol are accordingly particularly preferentially used. One particularly preferred nonionic surfactant is obtained from a straight-chain fatty alcohol having 16 to 20 carbon atoms ($C_{16-20}$ alcohol), preferably a $C_{18}$ alcohol, and at least 12 mole, preferably at least 15 mole and in particular at least 20 moles of ethylene oxide. Among these, "narrow range ethoxylates" are particularly preferred.

Combinations of one or more tallow fatty alcohols with 20 to 30 EO and silicone defoamers are particularly preferred.

Also, nonionic surfactants having a melting point of above room temperature are preferred. Nonionic surfactant(s) with a melting point of above 20° C., preferably of above 25° C., particularly preferably of between 25 and 60° C. and in particular of between 26.6 and 43.3° C., is/are particularly preferred.

Suitable nonionic surfactants having melting or softening points in the stated preferred temperature range are for example low-foaming nonionic surfactants that may be solid or highly viscous at room temperature. If nonionic surfactants that are highly viscous at room temperature are used, it is preferred for them to have a viscosity of above 20 Pa·s, preferably of above 35 Pa·s and in particular of above 40 Pa·s. Depending on their intended application, nonionic surfactants which have a waxy consistency at room temperature are also preferred.

Nonionic surfactants from the group of alkoxylated alcohols, particularly preferably from the group of mixed alkoxylated alcohols and in particular from the group of EO-AO-EO nonionic surfactants, are likewise particularly preferred for use herein.

Nonionic surfactants that are solid at room temperature preferably comprise propylene oxide (PO) units. Such PO units preferably constitute up to 25 wt. %, particularly preferably up to 20 wt. % and in particular up to 15 wt. % of the total molar mass of the nonionic surfactant. Particularly preferred nonionic surfactants are ethoxylated monohydroxyalkanols or alkylphenols that additionally comprise polyoxyethylene/polyoxypropylene block copolymer units. The alcohol or alkylphenol moiety of such nonionic surfactant molecules here preferably constitutes more than 30 wt. %, particularly preferably more than 50 wt. % and in particular more than 70 wt. % of the total molar mass of such nonionic surfactants. Preferred agents are characterized in that they contain ethoxylated and propoxylated nonionic surfactants, in which the propylene oxide units constitute in each molecule up to 25 wt. %, preferably up to 20 wt. % and in particular up to 15 wt. % of the entire molar mass of the nonionic surfactant.

Preferably used surfactants originate from the groups comprising alkoxylated nonionic surfactants, in particular ethoxylated primary alcohols and mixtures of these surfactants with structurally complex surfactants such as polyoxypropylene/polyoxyethylene/polyoxypropylene ((PO/EO/PO) surfactants). Such (PO/EO/PO) nonionic surfactants are furthermore distinguished by good foam control.

Further nonionic surfactants with a melting point above room temperature that are particularly preferable for use herein contain 40 to 70% of a polyoxypropylene/polyoxyethylene/polyoxypropylene block polymer blend, which contains 75 wt. % of a reverse block copolymer of polyoxyethylene and polyoxypropylene with 17 mol of ethylene oxide and 44 mol of propylene oxide and 25 wt. % of a block copolymer of polyoxyethylene and polyoxypropylene, initiated with trimethylolpropane and containing 24 mol of ethylene oxide and 99 mol of propylene oxide per mol of trimethylolpropane.

Nonionic surfactants that have proved to be particularly preferred for the purposes of the present invention are low-foaming nonionic surfactants which comprise alternating ethylene oxide and alkylene oxide units. Among these, surfactants with EO-AO-EO-AO blocks are in turn preferred, with in each case one to ten EO or AO groups being attached to one another before being followed by a block of the respective other groups. Preferred nonionic surfactants are those of the general formula:

$$R^1—O—(CH_2—CH_2—O)_w—(CH_2—\underset{\underset{R^2}{|}}{CH}—O)_x—(CH_2—CH_2—O)_y—(CH_2—\underset{\underset{R^3}{|}}{CH}—O)_z—H$$

in which $R^1$ denotes a straight-chain or branched, saturated or mono- or polyunsaturated $C_{6-24}$ alkyl or alkenyl residue; each group $R^2$ or $R^3$ is mutually independently selected from —$CH_3$, —$CH_2CH_3$, —$CH_2CH_2$—$CH_3$, $CH(CH_3)_2$ and the indices w, x, y, z mutually independently denote integers from 1 to 6.

The preferred nonionic surfactants of the above formula may be produced by known methods from the corresponding alcohols $R^1$—OH and ethylene or alkylene oxide. Residue $R^1$ in the above formula may vary depending on the origin of the alcohol. If natural sources are used, the residue $R^1$ comprises an even number of carbon atoms and is generally unbranched, preference being given to linear residues from alcohols of natural origin with 12 to 18 C atoms, for example from coconut, palm, tallow fat or oleyl alcohol. Alcohols obtainable from synthetic sources are for example Guerbet alcohols or residues methyl-branched in position 2 or linear and methyl-branched residues in a mixture as are conventionally present in oxo alcohol residues. Irrespective of the nature of the alcohol used for producing nonionic surfactants contained in the agents, preferred nonionic surfactants are those in which $R^1$ in the above formula denotes an alkyl residue with 6 to 24, preferably 8 to 20, particularly preferably 9 to 15 and in particular 9 to 11 carbon atoms.

Apart from propylene oxide, butylene oxide may also be considered as the alkylene oxide unit that alternates with the ethylene oxide unit in preferred nonionic surfactants. However, further alkylene oxides, in which $R^2$ or $R^3$ are mutually independently selected from —$CH_2CH_2$—$CH_3$ or —$CH(CH_3)_2$ are also suitable. Nonionic surfactants of the above formula which are preferably used are those in which $R^2$ or $R^3$ denotes a residue —$CH_3$, w and x mutually independently denote values of 3 or 4 and y and z mutually independently denote values of 1 or 2.

In summary, preferred nonionic surfactants are particularly those comprising a $C_{9-15}$ alkyl residue with 1 to 4 ethylene oxide units, followed by 1 to 4 propylene oxide units, followed by 1 to 4 ethylene oxide units, followed by 1 to 4 propylene oxide units. In aqueous solution, these surfactants exhibit the necessary low viscosity and may be of particular preference for use herein.

Nonionic surfactants from the group of hydroxy mixed ethers are particularly preferred, since, in comparison with nonionic surfactants from other classes of surfactants, these nonionic surfactants bring about distinctly better rinsing characteristics of the automatic dishwashing agents.

Surfactants of the general formula:

$$R^1—\underset{\underset{R^2}{|}}{CH(OH)}CH_2O\text{-}(AO)_w\text{-}(A'O)_x\text{-}(A''O)_y\text{-}(A'''O)_z—$$

in which $R^1$ and $R^2$ mutually independently denote a straight-chain or branched, saturated or mono- or polyunsaturated $C_{2-40}$ alkyl or alkenyl residue; A, A', A" and A'" mutually independently denote a residue from the group —$CH_2CH_2$, —$CH_2CH_2$—$CH_2$, —$CH_2$—$CH(CH_3)$, —$CH_2$—$CH_2$—$CH_2$—$CH_2$, —$CH_2$—$CH(CH_3)$—$CH_2$—, —$CH_2$—$CH(CH_2$—$CH_3)$; and w, x, y and z denote values between 0.5 and 90, with x, y and/or z possibly also being 0, are preferred in accordance with the present invention.

Particularly preferred phosphate-free automatic dishwashing agents of the present invention comprise a nonionic surfactant C having general formula:

$$R^1—\underset{\underset{R^2,}{|}}{CH(OH)}CH_2O\text{-}(AO)_w\text{-}(A'O)_x\text{-}(A''O)_y\text{-}(A'''O)_z—$$

in which $R^1$ denotes a straight-chain or branched, saturated or mono- or polyunsaturated $C_{6-24}$ alkyl or alkenyl residue; $R^2$ denotes a linear or branched hydrocarbon residue with 2 to 26 carbon atoms; A, A', A" and A'" mutually independently denote a residue from the group —$CH_2CH_2$, —$CH_2CH_2$—$CH_2$, —$CH_2$—$CH(CH_3)$, —$CH_2$—$CH_2$—$CH_2$—$CH_2$, —$CH_2$—$CH(CH_3)$—$CH_2$—, —$CH_2$—$CH(CH_2$—$CH_3)$; and, w, x, y and z denote values between 0.5 and 120, wherein x, y and/or z may also be 0.

In particular, preferred end group-terminated poly(oxyalkylated) nonionic surfactants are those having the formula $R^1O[CH_2CH_2O]_xCH_2CH(OH)R^2$, wherein residue $R^1$ comprises a linear or branched, saturated or unsaturated, aliphatic or aromatic hydrocarbon residue with 2 to 30 carbon atoms, preferably with 4 to 22 carbon atoms, and wherein residue $R^2$ comprises a linear or branched, saturated or unsaturated, aliphatic or aromatic hydrocarbon residue with 1 to 30 carbon atoms, and wherein x is between 1 and 90, preferably between 30 and 80, and in particular between 30 and 60.

Particularly preferred surfactants are those of the formula $R^1O[CH_2CH(CH_3)O]_x[CH_2CH_2O]_yCH_2CH(OH)R^2$, in which $R^1$ denotes a linear or branched aliphatic hydrocarbon residue with 4 to 18 carbon atoms or mixtures thereof, $R^2$ denotes a linear or branched hydrocarbon residue with 2 to 26 carbon atoms or mixtures thereof, x is between 0.5 and 1.5, and y is at least 15.

Due to the use of the above-described nonionic surfactants having a free hydroxyl group on one of the two terminal alkyl residues, it is possible to achieve distinct reduction in the formation of film deposits in automatic dishwashing in comparison with conventional polyalkoxylated fatty alcohols not having a free hydroxyl group.

Particularly preferred end group-terminated poly(oxyalkylated) nonionic surfactants include those of formula:

$$R^1O[CH_2CH_2O]_x[CH_2CH(R^3)O]_yCH_2CH(OH)R^2,$$

in which $R^1$ and $R^2$ mutually independently denote a linear or branched, saturated or mono- or polyunsaturated hydrocarbon residue with 2 to 26 carbon atoms, $R^3$ is mutually independently selected from —$CH_3$, —$CH_2CH_3$, —$CH_2CH_2$—$CH_3$, —$CH(CH_3)_2$, but preferably denotes —$CH_3$, and x and y mutually independently denote values between 1 and 32, with nonionic surfactants with $R^3$=—$CH_3$ and values of x from 15 to 32 and y from 0.5 and 1.5 being very particularly preferred.

Further preferably usable nonionic surfactants are the end group-terminated poly(oxyalkylated) nonionic surfactants of the formula:

$$R^1O[CH_2CH(R^3)O]_x[CH_2]_kCH(OH)[CH_2]_jOR^2,$$

in which $R^1$ and $R^2$ denote linear or branched, saturated or unsaturated, aliphatic or aromatic hydrocarbon residues with 1 to 30 carbon atoms, $R^3$ denotes H or a methyl, ethyl, n-propyl, iso-propyl, n-butyl, 2-butyl or 2-methyl-2-butyl residue, x denotes values between 1 and 30, k and j denote values between 1 and 12, preferably between 1 and 5. If the value of x is ≧2, each $R^3$ in the above formula $R^1O[CH_2CH(R^3)O]_x[CH_2]_kCH(OH)[CH_2]_jR^2$ may be different. $R^1$ and $R^2$ are preferably linear or branched, saturated or unsaturated, aliphatic or aromatic hydrocarbon residues with 6 to 22 carbon atoms, residues with 8 to 18 carbon atoms being particularly preferred. H, —$CH_3$ or —$CH_2CH_3$ are particularly preferred for the residue $R^3$. Particularly preferred values for x are in the range from 1 to 20, and in particular 6 to 15.

As described above, each $R^3$ in the above formula may be different if x is ≧2. In this manner, it is possible to vary the alkylene oxide unit in the square brackets. If x denotes 3, for example, the residue $R^3$ may be selected in order to form ethylene oxide ($R^3$═H) or propylene oxide ($R^3$═$CH_3$) units which may be attached to one another in any sequence, for example (EO)(PO)(EO), (EO)(EO)(PO), (EO)(EO)(EO), (PO)(EO)(PO), (PO)(PO)(EO) and (PO)(PO)(PO). The value 3 for x has been selected here by way of example and may perfectly well be larger, the range of variation increasing as the value of x rises and for example comprising a large number of (EO) groups combined with a small number of (PO) groups, or vice versa.

Particularly preferred end group-terminated poly(oxyalkylated) alcohols of the above-stated formula have values of k=1 and j=1, so simplifying the above formula to $R^1O[CH_2CH(R^3)O]_xCH_2CH(OH)CH_2OR^2$. In the latter-stated formula, $R^1$, $R^2$ and $R^3$ are as defined above and x denotes numbers from 1 to 30, preferably from 1 to 20 and in particular from 6 to 18. Particularly preferred surfactants are those in which the residues $R^1$ and $R^2$ comprise 9 to 14 C atoms, $R^3$ denotes H and x assumes values from 6 to 15.

The stated carbon chain lengths and degrees of ethoxylation or degrees of alkoxylation of the above-stated nonionic surfactants are statistical averages which, for a specific product, may be an integer or a fractional number. Due to production methods, commercial products of the stated formulae do not in the main consist of an individual representative, but instead of mixtures, whereby not only the C-chain lengths but also the degrees of ethoxylation or degrees of alkoxylation may be averages and consequently fractional numbers.

The above-stated nonionic surfactants may, of course, be used not only as individual substances, but also as surfactant mixtures of two, three, four or more surfactants. Surfactant mixtures do not here comprise mixtures of nonionic surfactants all of which fall within one of the above-stated general formulae, but instead such mixtures that contain two, three, four or more nonionic surfactants described by the various general formulae shown above.

In one particularly preferred embodiment, the phosphate-free automatic dishwashing agents according to the invention comprise:

(a) 2 to 10 wt. % of hydrophobically modified copolymer A, comprising:
- monomers from the group of mono- or polyunsaturated sulfonic acids;
- monomers from the group of mono- or polyunsaturated carboxylic acids;
- monomers of the general formula $R^1(R^2)C{=}C(R^3)—X—R^4$, in which $R^1$ to $R^3$ mutually independently denote —H, —$CH_3$ or —$C_2H_5$, X denotes an optionally present spacer group which is selected from —$CH_2$—, —C(O)O— and —C(O)—NH—, and $R^4$ denotes a straight-chain or branched saturated alkyl residue with 2 to 22 carbon atoms or denotes an unsaturated, preferably aromatic residue with 6 to 22 carbon atoms;

(b) 4 to 14 wt. % of non-hydrophobically modified copolymer B, comprising:
- monomers from the group of mono- or polyunsaturated sulfonic acids;
- monomers from the group of mono- or polyunsaturated carboxylic acids;

(c) 1 to 7 wt. % of nonionic surfactant of general formula $R^1—CH(OH)CH_2O\text{-}(AO)_w\text{-}(A'O)_x\text{-}(A''O)_y\text{-}(A'''O)_z—R^2$, in which
- $R^1$ denotes a straight-chain or branched, saturated or mono- or polyunsaturated $C_{6\text{-}24}$ alkyl or alkenyl residue;
- $R^2$ denotes a linear or branched hydrocarbon residue with 2 to 26 carbon atoms;
- A, A', A'' and A''' mutually independently denote a residue from the group —$CH_2CH_2$, —$CH_2CH_2$—$CH_2$, —$CH_2$—CH($CH_3$), —$CH_2$—$CH_2$—$CH_2$—$CH_2$, —$CH_2$—CH($CH_3$)—$CH_2$—, —$CH_2$—CH($CH_2$—$CH_3$); and
- w, x, y and z denote values between 0.5 and 120, wherein x, y and/or z may also be 0;

(d) 10 to 50 wt. % of citrate and citric acid; and (e) 2 to 15 wt. % of sodium percarbonate.

TABLE 4 below shows some further example formulations for preferred automatic dishwashing agents according to the invention.

TABLE 4

Additional Exemplary Automatic Dishwashing Agents

| Ingredient | Formulation 1 [wt. %] | Formulation 2 [wt. %] | Formulation 3 [wt. %] | Formulation 4 [wt. %] |
|---|---|---|---|---|
| Citrate | 5.0 to 60 | 10 to 50 | 10 to 50 | 15 to 40 |
| Carbonate | 5.0 to 50 | 5.0 to 50 | 10 to 40 | 15 to 30 |
| Sodium percarbonate | 1.0 to 20 | 2.0 to 15 | 2.0 to 15 | 4.0 to 12 |
| Copolymer A[1)] | 1.0 to 12 | 2.0 to 10 | 2.0 to 10 | 3.0 to 8.0 |
| Copolymer B[2)] | 2.0 to 16 | 4.0 to 14 | 4.0 to 14 | 6.0 to 12 |
| Nonionic surfactant C[3)] | 0.5 to 8 | 1.0 to 7.0 | 1.0 to 7.0 | 2.0 to 6.0 |
| Bleach activator | 0 to 8 | 0 to 8 | 0 to 8 | 2.0 to 6.0 |
| Bleach catalyst | 0 to 5.0 | 0 to 1.0 | 0 to 1.0 | 0.0025 to 1.0 |
| Phosphonate | 0 to 8.0 | 1 to 8.0 | 0 to 8.0 | 0 to 8.0 |
| Misc. | q.s | q.s | q.s | q.s |

NOTES:

[1)]Copolymer A in TABLE 4 comprises:

monomers from the group of mono- or polyunsaturated sulfonic acids monomers from the group of mono- or polyunsaturated carboxylic acids monomers of the general formula $R^1(R^2)C{=}C(R^3)—X—R^4$, in which $R^1$ to $R^3$ mutually independently denote —H, —$CH_3$ or —$C_2H_5$, X denotes an optionally present spacer group which is selected from —$CH_2$—, —C(O)O—and —C(O)—NH—, and $R^4$ denotes a straight-chain or branched saturated alkyl residue with 2 to 22 carbon atoms or denotes an unsaturated, preferably aromatic residue with 6 to 22 carbon atoms.

[2)]Copolymer B in TABLE 4 comprises: monomers from the group of mono- or polyunsaturated sulfonic acids monomers from the group of mono- or polyunsaturated carboxylic acids

[3)]The nonionic surfactant in TABLE 4 has the general formula $R^1—CH(OH)CH_2O—(AO)_w—(A'O)_x—(A''O)_y—(A'''O)_z—R^2$, in which $R^1$ denotes a straight-chain or branched, saturated or mono- or polyunsaturated $C_{6\text{-}24}$ alkyl or alkenyl residue;

$R^2$ denotes a linear or branched hydrocarbon residue with 2 to 26 carbon atoms;

A, A', A'' and A''' mutually independently denote a residue from the group —$CH_2CH_2$, —$CH_2CH_2$—$CH_2$, —$CH_2$—CH($CH_3$), —$CH_2$—$CH_2$—$CH_2$—$CH_2$, —$CH_2$—CH($CH_3$)—$CH_2$—, —$CH_2$—CH($CH_2$—$CH_3$), w, x, y and z denote values between 0.5 and 120, wherein x, y and/or z may also be 0.

In addition to colorants and scents, optional components of agents according to the invention include enzymes used to enhance the washing or cleaning performance of washing or cleaning agents. These include in particular proteases, amylases, lipases, hemicellulases, cellulases, perhydrolases or oxidoreductases, and preferably mixtures thereof. These enzymes are in principle of natural origin; starting from the natural molecules, improved variants are available for use in washing or cleaning agents, said variants accordingly preferably being used. Washing or cleaning agents preferably contain enzymes in total quantities of $1\times10^{-6}$ to 5 wt. % relative to active protein. Protein concentration may be determined with the assistance of known methods, for example the BCA method or the biuret method.

Among proteases, those of the subtilisin type are preferred. Examples of these are subtilisins BPN' and Carlsberg and their further developed forms protease PB92, subtilisins 147 and 309, alkaline protease from *Bacillus lentus*, subtilisin DY and the enzymes thermitase, proteinase K and proteases TW3 and TW7, which are classed among subtilases but no longer among the subtilisins as more narrowly defined.

Examples of amylases usable according to the invention are the α-amylases from *Bacillus licheniformis*, from *B. amyloliquefaciens*, from *B. stearothermophilus*, from *Aspergillus niger* and *A. oryzae* and the further developed forms of the above-stated amylases which have been improved for use in washing and cleaning agents. Particular note should furthermore be taken for this purpose of the α-amylase from *Bacillus* sp. A 7-7 (DSM 12368) and the cyclodextrin glucanotransferase (CGTase) from *B. agaradherens* (DSM 9948).

Lipases or cutinases, in particular because of their triglyceride-cleaving activities, but also in order to produce peracids in situ from suitable precursors may furthermore be used according to the invention. These include, for example, lipases originally obtainable or further developed from *Humicola lanuginosa* (*Thermomyces lanuginosus*), in particular those with the D96L amino acid substitution. Furthermore, the cutinases which were originally isolated from *Fusarium solani pisi* and *Humicola insolens* are, for example, also usable. Lipases or cutinases, the initial enzymes of which were originally isolated from *Pseudomonas mendocina* and *Fusarium solanii*, may furthermore be used.

Enzymes which fall within the class of hemicellulases may furthermore be used. These include, for example, mannanases, xanthan lyases, pectin lyases (=pectinases), pectin esterases, pectate lyases, xyloglucanases (=xylanases), pullulanases and β-glucanases.

Oxidoreductases for example oxidases, oxygenases, catalases, peroxidases, such as halo-, chloro-, bromo-, lignin, glucose or manganese peroxidases, dioxygenases or laccases (phenol oxidases, polyphenol oxidases) may be used according to the invention to increase bleaching action. Compounds, preferably organic compounds, particularly preferably aromatic compounds, which interact with the enzymes, are also added in order to enhance the activity of the oxidoreductases in question (enhancers) or, in the event of a major difference in redox potential between the oxidizing enzymes and the soiling, to ensure electron flow (mediators).

The enzymes may be used in any form established in the prior art. This includes, for example, solid preparations obtained by granulation, extrusion or freeze-drying or, in particular in the case of preparations in liquid or gel form, solutions of the enzymes, advantageously as concentrated as possible, with a low water content and/or combined with stabilizers.

Alternatively, both for the solid and the liquid presentation, the enzymes may be encapsulated, for example by spray drying or extruding the enzyme solution together with a preferably natural polymer or in the form of capsules, for example those in which the enzymes are enclosed for instance in a solidified gel or those of the core-shell type, in which an enzyme-containing core is coated with a protective layer which is impermeable to water, air and/or chemicals. Further active ingredients, for example stabilizers, emulsifiers, pigments, bleaching agents or dyes may additionally be applied in superimposed layers. Such capsules are applied in accordance with per se known methods, for example by agitated or rolling granulation or in fluidized bed processes. Advantageously, such granules are low-dusting, for example due to the application of polymeric film formers, and stable in storage thanks to the coating.

It is furthermore possible to formulate two or more enzymes together such that a single granular product comprises two or more enzyme activities.

A protein and/or enzyme may be protected, particularly during storage, from damage such as for example inactivation, denaturation or degradation for instance due to physical influences, oxidation or proteolytic cleavage. If the proteins and/or enzymes are isolated from microbes, inhibition of proteolysis is particularly preferred, in particular if the agents also contain proteases. Washing or cleaning agents may contain stabilizers for this purpose; the provision of such agents constitutes a preferred embodiment of the present invention.

One or more enzymes and/or enzyme preparations, preferably solid protease preparations and/or amylase preparations, are preferably used in quantities of 0.1 to 12 wt. %, preferably of 0.2 to 8 wt. % and in particular of 0.5 to 8 wt. %, in each case relative to the total enzyme-containing agent.

In a further particularly preferred embodiment, the phosphate-free automatic dishwashing agents according to the invention comprises:

a) hydrophobically modified copolymer A, comprising
   - monomers from the group of mono- or polyunsaturated sulfonic acids
   - monomers from the group of mono- or polyunsaturated carboxylic acids
   - monomers aiii) of the general formula $R^1(R^2)C{=}C(R^3)$—X—$R^4$, in which $R^1$ to $R^3$ mutually independently denote —H, —$CH_3$ or —$C_2H_5$, X denotes an optionally present spacer group which is selected from —$CH_2$—, —C(O)O— and —C(O)—NH—, and $R^4$ denotes a straight-chain or branched saturated alkyl residue with 2 to 22 carbon atoms or denotes an unsaturated, preferably aromatic residue with 6 to 22 carbon atoms;

b) non-hydrophobically modified copolymer B, comprising
   - monomers from the group of mono- or polyunsaturated sulfonic acids
   - monomers from the group of mono- or polyunsaturated carboxylic acids;

c) nonionic surfactant of the general formula $R^1$—CH(OH)$CH_2O$-$(AO)_w$-$(A'O)_x$-$(A''O)_y$-$(A'''O)_z$—$R^2$, in which
   - $R^1$ denotes a straight-chain or branched, saturated or mono- or polyunsaturated $C_{6-24}$ alkyl or alkenyl residue;
   - $R^2$ denotes a linear or branched hydrocarbon residue with 2 to 26 carbon atoms;
   - A, A', A'' and A''' mutually independently denote a residue from the group —$CH_2CH_2$, —$CH_2CH_2$—$CH_2$, —$CH_2$—CH($CH_3$), —$CH_2$—$CH_2$—$CH_2$—$CH_2$, —$CH_2$—CH($CH_3$)—$CH_2$—, —$CH_2$—CH($CH_2$—$CH_3$),
   - w, x, y and z denote values between 0.5 and 120, wherein x, y and/or z may also be 0;

d) citrate and/or citric acid;

e) sodium percarbonate;

f) bleach catalyst and/or bleach activator;

g) phosphonate; and h) enzyme.

TABLE 5 below shows some further example formulations of preferred automatic dishwashing agents according to the present invention.

TABLE 5

Additional Exemplary Automatic Dishwashing Agents

| Ingredient | Formulation 1 [wt. %] | Formulation 2 [wt. %] | Formulation 3 [wt. %] | Formulation 4 [wt. %] |
|---|---|---|---|---|
| Citrate | 5.0 to 60 | 10 to 50 | 10 to 50 | 15 to 40 |
| Carbonate | 5.0 to 50 | 5.0 to 50 | 10 to 40 | 15 to 30 |
| Sodium percarbonate | 1.0 to 20 | 2.0 to 15 | 2.0 to 15 | 4.0 to 12 |
| Copolymer A | 1.0 to 12 | 2.0 to 10 | 2.0 to 10 | 3.0 to 8.0 |
| Copolymer B | 2.0 to 16 | 4.0 to 14 | 4.0 to 14 | 6.0 to 12 |
| Nonionic surfactant C | 0.5 to 8 | 1.0 to 7.0 | 1.0 to 7.0 | 2.0 to 6.0 |
| Bleach activator | 0 to 8 | 0 to 8 | 0 to 8 | 2.0 to 6.0 |
| Bleach catalyst | 0 to 5.0 | 0 to 1.0 | 0 to 1.0 | 0.0025 to 1.0 |
| Phosphonate | 0 to 8.0 | 1 to 8.0 | 0 to 8.0 | 0 to 8.0 |
| Enzyme preparation(s) | 0.1 to 12 | 0.1 to 12 | 0.5 to 8.0 | 0.5 to 8.0 |
| Misc. | q.s | q.s | q.s | q.s |

The present application also provides a method for cleaning dishes in a dishwashing machine using an automatic dishwashing agent according to the invention, the automatic dishwashing agent preferably being dispensed into the interior of a dishwashing machine during the performance of a dishwashing program, before the start of the main washing cycle or in the course of the main washing cycle. Dispensing or introduction of the agent according to the invention into the interior of the dishwashing machine may proceed manually, but the agent is preferably dispensed into the interior of the dishwashing machine by means of the dispensing chamber of the dishwashing machine.

Preferred methods according to the invention are characterized in that no additional water softener and no additional rinse aid are dispensed into the interior of the dishwashing machine during the course of the cleaning method.

The automatic dishwashing agents according to the invention exhibit their advantageous rinsing characteristics particularly in low temperature cleaning methods. Preferred dishwashing methods using agents according to the invention are therefore characterized in that the dishwashing methods are carried out at a liquor temperature of below 60° C., preferably of below 50° C.

The quantity of automatic dishwashing agents according to the invention used in preferred embodiments of the method according to the invention amounts to 12 to 26 g, preferably to 14 to 24 g and in particular to 16 to 22 g.

As has been explained above, the automatic dishwashing agents according to the invention are distinguished by excellent rinsing characteristics. This applies in particular with regard to the avoidance of film deposition onto glass or plastics surfaces in automatic dishwashing. The present application accordingly finally provides the use of an automatic dishwashing agent according to the invention for avoiding film deposition onto glass surfaces or plastics surfaces in automatic dishwashing.

We claim:

1. A phosphate-free automatic dishwashing agent comprising:

a) builder;

b) bleaching agent;

c) hydrophobically modified copolymer, said hydrophobically modified copolymer comprising at least one of mono- and polyunsaturated sulfonic acid monomers;

d) non-hydrophobically modified copolymer, said non-hydrophobically modified copolymer comprising at least one of mono- and polyunsaturated sulfonic acid monomers; and e) nonionic surfactant.

2. The agent of claim 1, wherein said hydrophobically-modified copolymer further comprises:

a) at least one of mono- and polyunsaturated carboxylic acid monomers; and b) monomers of the general formula: $R^1(R^2)C{=}C(R^3)$—X—$R^4$, wherein $R^1$ to $R^3$ are independently —H, —$CH_3$ or —$C_2H_5$; X is an optional spacer group selected from the group —$CH_2$—, —C(O)O—, and —C(O)—NH—; and $R^4$ is selected from the group consisting of straight-chain saturated alkyl residues having 2 to 22 carbon atoms, branched saturated alkyl residues having 2 to 22 carbon atoms, and unsaturated alkyl residues having 6 to 22 carbon atoms, and mixtures thereof.

3. The agent of claim 1, wherein said hydrophobically modified copolymer is present from 1 to 12 wt. %.

4. The agent of claim 1, wherein said non-hydrophobically modified copolymer further comprises at least one of mono- and polyunsaturated carboxylic acid monomers.

5. The agent of claim 1, wherein said non-hydrophobically modified copolymer is present from 2 to 16 wt. %.

6. The agent of claim 1, wherein said nonionic surfactant comprises the general structure $R^1$—$CH(OH)CH_2O$-$(AO)_w$-$(A'O)_x$-$(A''O)_y$-$(A'''O)_z$—$R^2$, in which $R^1$ is a straight-chain or branched, saturated or mono- or polyunsaturated $C_{6-24}$ alkyl or alkenyl residue; $R^2$ is a linear or branched hydrocarbon residue with 2 to 26 carbon atoms; A, A', A'' and A''' are independently a residue from the group —$CH_2CH_2$, —$CH_2CH_2$—$CH_2$, —$CH_2$—$CH(CH_3)$, —$CH_2$—$CH_2$—$CH_2$—$CH_2$, —$CH_2$—$CH(CH_3)$—$CH_2$—, —$CH_2$—$CH(CH_2$—$CH_3)$; and w, x, y and z are between 0.5 and 120 wherein any of x, y, and z are optionally 0.

7. The agent of claim 1, wherein said nonionic surfactant is present from 0.5 to 8 wt. %.

8. The agent of claim 1, wherein said builder is present from 5 to 60 wt. % and comprises at least one of citric acid and a citrate salt.

9. The agent of claim 1, wherein said bleaching agent is sodium percarbonate, present from 1 to 20 wt. %.

10. A phosphate-free automatic dishwashing agent comprising:

a) from 10 to 50 wt. % of at least one of citric acid and a citrate salt;

b) from 2 to 15 wt. % sodium percarbonate;

c) from 2 to 10 wt. % of hydrophobically modified copolymer, said hydrophobically modified copolymer comprising:

i. at least one of mono- and polyunsaturated sulfonic acid monomers;

ii. at least one of mono- and polyunsaturated carboxylic acid monomers; and iii. monomers of the general formula: $R^1(R^2)C{=}C(R^3)$—X—$R^4$, wherein $R^1$ to $R^3$ are independently —H, —$CH_3$ or —$C_2H_5$; X is an optional spacer group selected from the group —$CH_2$—, —C(O)O—, and —C(O)—NH—; and $R^4$ is selected from the group consisting of straight-chain saturated alkyl residues having 2 to 22 carbon atoms, branched saturated alkyl residues having 2 to 22 carbon atoms, and unsaturated alkyl residues having 6 to 22 carbon atoms, and mixtures thereof;

d) from 4 to 14 wt. % of non-hydrophobically modified copolymer, said non-hydrophobically modified copolymer comprising:
   i. at least one of mono- and polyunsaturated sulfonic acid monomers; and
   ii. at least one of mono- and polyunsaturated carboxylic acid monomers; and e) from 1 to 7 wt. % nonionic surfactant, said nonionic surfactant having the general structure $R^1$—CH(OH)$CH_2O$-$(AO)_w$-$(A'O)_x$-$(A''O)_y$-$(A'''O)_z$—$R^2$, in which $R^1$ is a straight-chain or branched, saturated or mono- or polyunsaturated $C_{6-24}$ alkyl or alkenyl residue; $R^2$ is a linear or branched hydrocarbon residue with 2 to 26 carbon atoms; A, A', A'' and A''' are independently a residue from the group —$CH_2CH_2$, —$CH_2CH_2$—$CH_2$, —$CH_2$—$CH(CH_3)$, —$CH_2$—$CH_2$—$CH_2$—$CH_2$, —$CH_2$—$CH(CH_3)$—$CH_2$—, —$CH_2$—$CH(CH_2$—$CH_3)$; and w, x, y and z are between 0.5 and 120 wherein any of x, y, and z are optionally 0.

11. The agent of claim 10, further comprising any one of a bleach catalyst, a bleach activator, a phosphonate, and an enzyme.

* * * * *